US005323937A

United States Patent [19]

Brody

[11] Patent Number: 5,323,937

[45] Date of Patent: Jun. 28, 1994

[54] SPRAY CAN ACTUATION DEVICE WITH IMPROVED CAN RETENTION

[75] Inventor: Harvey Brody, Costa Mesa, Calif.

[73] Assignee: Delshar Industries, Inc., Santa Ana, Calif.

[21] Appl. No.: 73,730

[22] Filed: Jun. 8, 1993

[51] Int. Cl.[5] ..... B65D 83/14

[52] U.S. Cl. ..... 222/402.11; 222/402.15; 222/474

[58] Field of Search ..... 222/153, 174, 182, 321, 222/323, 402.11–402.15, 472–475, 509; 239/DIG. 22, 526, 578

[56] References Cited

U.S. PATENT DOCUMENTS

| | | | |
|---|---|---|---|
| 2,877,934 | 3/1959 | Wallace | 222/323 |
| 3,172,582 | 3/1965 | Belpedio | 222/473 |
| 3,937,368 | 2/1976 | Hoagland | 222/402.11 |
| 4,432,474 | 2/1984 | Hutchinson et al. | 222/402.15 |
| 4,449,647 | 5/1984 | Reed et al. | 222/153 |
| 4,505,335 | 3/1985 | Hayba | 169/76 |
| 4,805,812 | 2/1989 | Brody | 222/402.11 |
| 5,086,954 | 2/1992 | Brody | 222/402.11 |

FOREIGN PATENT DOCUMENTS

| | | | |
|---|---|---|---|
| 1163978 | 10/1969 | United Kingdom | B65B 1/30 |
| 1343881 | 1/1974 | United Kingdom | B65D 83/14 |
| 2001706 | 2/1979 | United Kingdom | B65D 83/14 |
| 2038952 | 7/1980 | United Kingdom | B65D 83/14 |

*Primary Examiner*—Andres Kashnikow
*Assistant Examiner*—Kenneth DeRosa
*Attorney, Agent, or Firm*—Klein & Szekeres

[57] ABSTRACT

A spray can actuation device includes a body that is removably attachable to the top of a spray can. The body includes a handle and a valve actuation lever, operated by a trigger, that engages the push-button valve on the can when the trigger is pressed. A locking plate is pivotally attached to the forward portion of the body for movement between an unlocked position, in which the actuation lever is allowed to engage the valve, and a locked position, in which the lever is locked out of engagement with the valve. The forward portion of the body includes a rim that is engageable with the channel that typically surrounds the valve on such spray cans. The rim is formed by a pair of rim halves, each with a reduced-thickness side wall portion, and joined at the front by an interlocking connection, preferably a pin-and-socket joint. Each of the side wall portions has an aperture arrangement that increases the flexibility of the side wall portion without significantly degrading its structural strength or integrity. During the insertion of the rim into the channel, the rim resiliently flexes at the side walls, while the interlocking connection substantially prevents relative movement between the rim halves, thereby facilitating the attachment of the device to the can, and making the attachment more secure.

9 Claims, 2 Drawing Sheets

SPRAY CAN ACTUATION DEVICE WITH IMPROVED CAN RETENTION

INCORPORATION BY REFERENCE OF RELATED PATENT DISCLOSURE

The subject matter of this application is related to that of applicant's prior U.S. Pat. No. 5,086,954, the disclosure of which is incorporated herein by reference.

BACKGROUND OF THE INVENTION

The present invention relates to a device for both holding a pressurized container, such as a spray can, and for actuating the valve of the container to dispense its pressurized contents. More particularly, the present invention relates to an improvement in such devices, whereby these devices can remain attached to a spray can with much reduced risk of an inadvertent actuation of the valve.

Spray can holding and actuation devices are well known in the art, as exemplified by the following U.S. Pat. Nos. 2,877,934—Wallace; 3,172,582—Belpedio; 3,189,232—Joffe; and 4,089,440—Lee. Further examples of such actuation devices are disclosed in the following British patent specifications; 1,163,978; 1,343,881; 1,487,719; 2,001,706 (published application); and 2,038,952 (published application).

Of the prior art spray can actuation devices, one of the more popular types has the general configuration of a pistol, as particularly exemplified in U.S. Pat. No. 5,086,954—Brody; 4,805,812—Brody; and U.S. Pat. No. 4,432,474—Hutchinson et al. These pistol-shaped devices typically include a body that has a pistol-grip handle, and means on the front of the body for removable attachment to the top of a spray can, of the type having a push-button valve. The body carries a valve actuation member that is operably linked or connected to a trigger, the latter being situated with respect to the handle in a manner similar to the trigger of a pistol. The linkage between the actuation member and the trigger is such that when the trigger is squeezed or depressed, the actuation member is brought into operable engagement with the push-button valve, thereby actuating the valve to dispense the contents of the container.

The devices disclosed in the Brody patents add to this basic structure a mechanism for disabling or locking the push-button actuation mechanism. This locking mechanism comprises a locking plate having a portion pivotally connected to the body of the device adjacent to the attachment means, the plate having a notch dimensioned to receive the valve actuation member. The plate is pivotable between a first position in which it is out of the path of travel between the valve actuation member and the push-button valve, and a second position wherein the valve actuation member is received in the notch so as to be restrained from moving into engagement with the valve.

A further improvement was disclosed and claimed in U.S. Pat. No. 5,086,954—Brody. A spray can actuation device in accordance with this patent includes a can retention lip or rim is configured for easier and more positive engagement with the channel surrounding the push-button valve on a spray can. More specifically, the lip or rim is configured with relatively thick front and back portions, connected by side wall portions having reduced-thickness flexure points, so as to be resiliently flexible. The front portion is provided with a pin-and-socket arrangement that gives increased rigidity to the front portion, so that when the rim is inserted into the can channel, front portion first, the front portion substantially maintains its shape and integrity while the side portions flex at the flexure points to allow the back portion to be inserted into the channel. By maintaining the rigidity of the front portion, while increasing the flexibility of the side wall portions, a more positive and secure locking engagement between the rim and the channel is achieved.

While the prior art spray can devices have added greatly to the convenience and safety of using spray cans, their widespread use has revealed the desirability of further improvements and refinements. For example, while devices constructed in accordance with the above-mentioned U.S. Pat. Nos. 4,805,812 and 5,086,954 have achieved great commercial success, it is felt that further improvements would enhance their appeal and utility to the user.

One such improvement would be to provide greater flexibility in the side wall portions of the rim, thereby to facilitate the installation of the rim into the can channel. The natural inclination in this regard would be to minimize the thickness of the hinge sections of the side wall portions of the rim. There is a limit, however, to how thin these side wall portions can be made without seriously degrading their structural integrity and durability, leading to premature breakage. A further limit on the thinness of these sections is imposed by the plastic flow considerations in the injection molding process used to make these devices.

Thus, there has been a heretofore unresolved need to provide greater flexibility in the rim without seriously degrading its structural integrity or durability, and to provide such increased flexibility in a manner that can be easily accomplished with conventional injection molding techniques.

SUMMARY OF THE INVENTION

Broadly, the present invention is an improved spray can actuation device, of the type most closely exemplified by the above-mentioned U.S. Pat. No. 5,086,954—Brody, including a lip or rim that is generally configured as the lip or rim disclosed in U.S. Pat. No. 5,086,954 (briefly described above), wherein the improvement comprises means in the side walls for increasing the flexibility of the side walls without significantly detracting from their structural strength, integrity, or durability. In a specific preferred embodiment, the flexibility enhancing means comprises a removed side wall portion, in the form of one or more apertures in a flexible reduced-thickness section of each of the side wall portions.

The present invention thus provides a significant enhancement that is easily incorporated into existing spray can actuation devices, of the type generally disclosed in the aforementioned U.S. Pat. No. 5,086,954. Moreover, this enhancement can be readily achieved using conventional injection molding techniques.

DETAILED DESCRIPTION OF A PREFERRED EMBODIMENT

Figure 1:
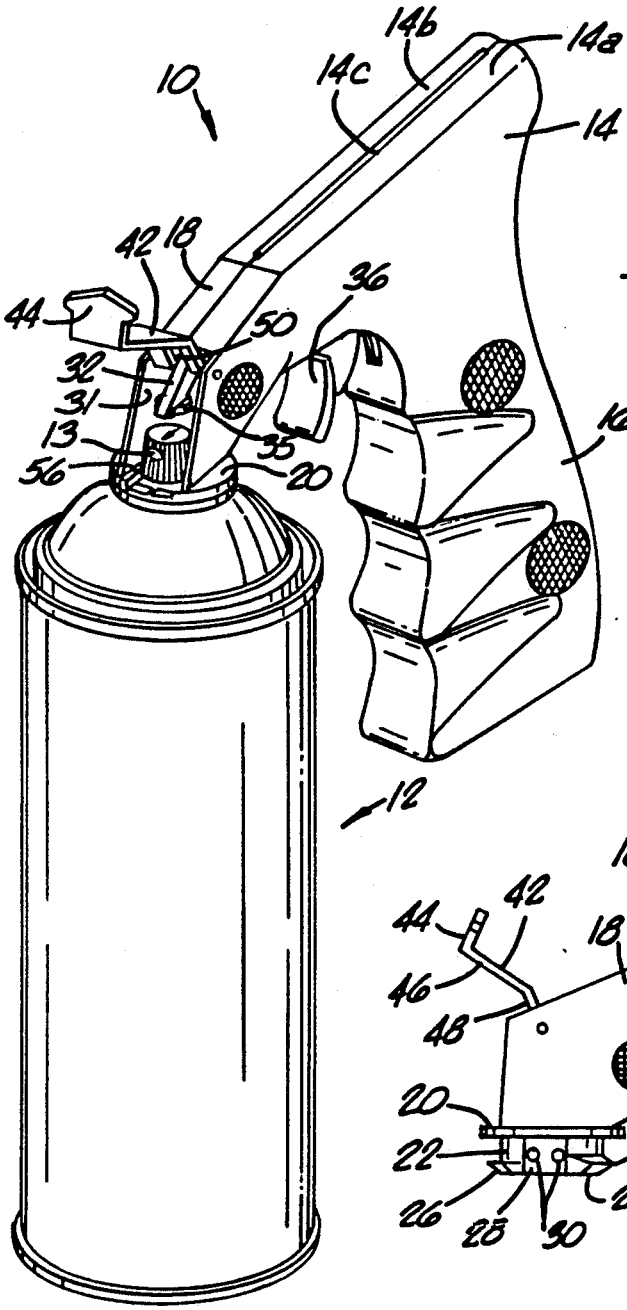
FIG. 1 is a perspective view of a spray can actuation and holding device, in accordance with a preferred embodiment of the present invention, showing the device attached to a pressurized spray can.
Figure 2:
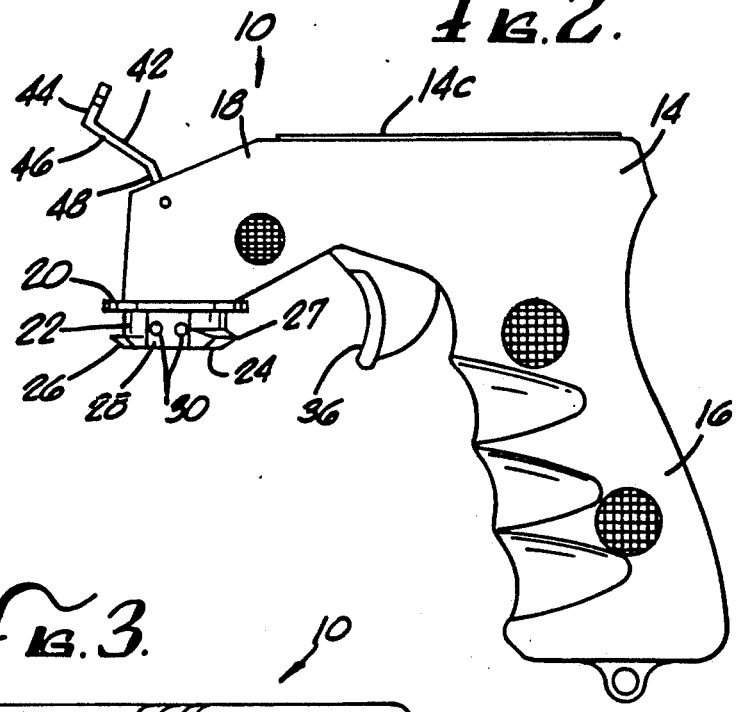
FIG. 2 is a side elevational view of the embodiment of FIG. 1, showing the device detached from the can.
Figure 4:
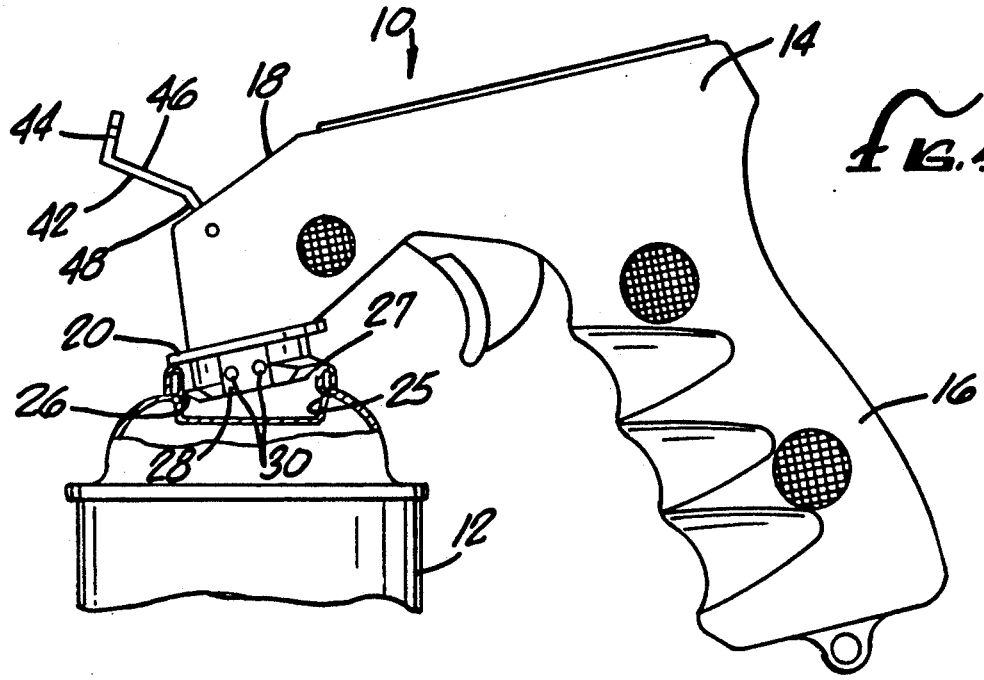
FIG. 4 is a side elevational of the preferred embodiment, showing the process of attaching it to a spray can of the type shown in FIG. 1.
Figure 5:
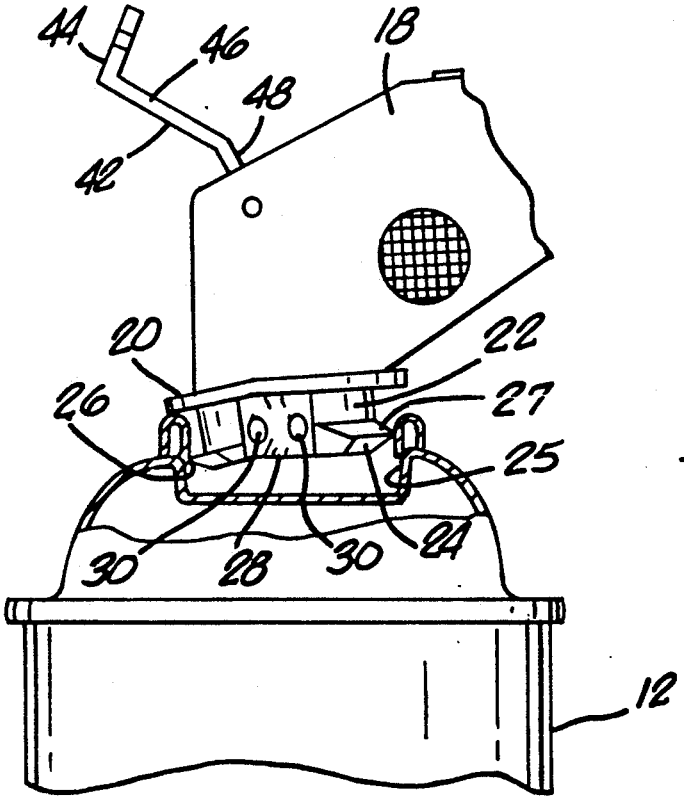
FIG. 5 is an enlarged view of a portion of FIG. 4, showing the process of attaching the device to a spray can.

Referring now to the drawings, FIG. 1 shows an improved actuation and holding device 10, in accordance with the preferred embodiment of the present invention, attached to a pressurized container or can 12, having a push-button spray valve 13. The actuation and holding device 10 has a body 14 that would typically be made of molded plastic by conventional techniques, well-known in the art, such as the "butterfly" injection molding method. The body 14 includes a pistol grip handle 16 and a forward portion 18 that extends in a generally downward direction, terminating in a generally annular shoulder 20, interrupted in the front by a gap. Extending downwardly from the shoulder 20 is an annular extension 22 that terminates in an annular rim or lip 24. As best shown in FIGS. 4 and 5, the rim 24 is dimensioned to be received in an annular channel 25 formed in the top of the pressurized container 12, around the push-button valve 13. The rim 24 thus provides means for removably attaching the device 10 to the container 12.

Figure 3:
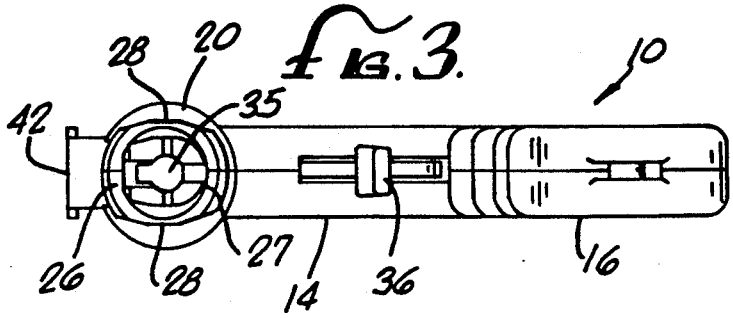
FIG. 3 is a bottom plan view of the preferred embodiment of the invention.

As shown in FIG. 3, the rim 24 includes a front portion 26 and a back portion 27, joined by a pair of opposed side portions 28. The front and back portions are relatively thick and inflexible, while each of the side wall portions 28 includes a relatively thin (i.e., reduced-thickness), resiliently flexible area that forms an integral hinge between the front portion 26 and the back portion 27.

To increase the flexibility of the side portions 28, one or more removed side wall portion areas, in the form of apertures 30, are provided in each side wall portion 28. Preferably, two such apertures 30 are provided, in substantially horizontal alignment, in each of the side wall portions 28. The apertures 30 increase the flexibility of the side wall portions 28 to facilitate the insertion of the rim 24 into the annular channel 25 of the container 12, as shown in FIGS. 4 and 5.

This increased degree of flexibility in the side wall portions 28 is accomplished without significantly degrading their structural integrity or their durability, since the flexibility can be significantly increased with only a moderate reduction in wall thickness. Moreover, the formation of the removed areas (apertures) is easily accomplished in conventional injection molding techniques, as is well known in the art.

When the device is formed by the butterfly molding method, the body 14 is initially formed in two axial or longitudinal halves 14*a* and 14*b*, joined along a longitudinal hinge 14*c*. The rim 24 is therefore also longitudinally divided into two rim halves. The front portion of one rim half has a laterally extending pin (not shown), while the front portion of the other rim half has a socket (not shown) that receives the pin when the two halves are folded together along the hinge 14*c*.

The mating of the pin and the socket creates a reinforcement for the front portion 26 of the rim 24, while substantially preventing relative movement of the rim halves during insertion. Because of the resulting increased rigidity of the front portion 26, the front portion maintains its shape and integrity when the rim 24 is inserted into the container channel 25, front portion first, as shown in FIGS. 4 and 5. The side portions 28, on the other hand, resiliently flex, due both to their relative thinness, and to the presence of the apertures 30. The flexing of the side portions 28 allows the back portion 27 of the rim 24 to be brought into the channel 25. The frontal gap in the shoulder 20 facilitates the movement of the front portion 26 of the rim 24 toward the back portion 27, while assuring the flexing of the side portions 28. By thus maintaining the rigidity and structural integrity of the front portion 26 of the rim 24, while increasing the flexibility of the side portions 28 without significantly compromising their structural integrity, the above-described rim structure allows the rim 24 to be both more easily and securely locked into the channel 25, as compared with those devices lacking this type of rim construction.

The front of the body 14 above the shoulder 20 is provided with an opening 31, through which the contents of the container 12 are dispensed from the valve 13. The opening 31 is substantially rectangular in outline and is defined on the bottom by the shoulder 20, and on the sides and top by the wall surface of the forward portion 18 of the body.

As best shown in FIG. 1, the device 10 includes a valve actuation member comprising a lever 32 disposed longitudinally within the body. The lever 32 has a first or free end which extends through the forward portion 18 of the body and into the opening 31, thereby being disposed just above the valve 13. The free end terminates in a laterally-extended surface in the form of a flattened disk 35 that provides a flat, substantially circular surface for effecting a positive engagement with the valve, as described below. The other end of the lever extends through an opening in the underside of the body and is configured in the shape of a trigger 36. The actuation lever 32 pivots on a pin (not shown) when the trigger 36 is pressed toward the handle 16, thereby causing the free end to pivot downwardly to bring the disk 35 into operative engagement against valve 13. In this manner, the valve 13 is depressed to dispense the contents of the container. The actuation lever 32 may include a resilient, rearwardly-extending extension (not shown) that engages an interior surface of the body, and that acts as a spring to assist the return of the lever to its original position when the trigger 36 is released. In this original position, the free end of the lever 32 is out of engagement with the valve 13, as shown in FIG. 3.

In accordance with the preferred embodiment of the present invention, actuation lever locking means are provided for selectively locking the valve actuation lever 32 in a position disengaged from the valve 13. This locking means includes a locking plate 42. The locking plate 42 includes a substantially horizontal base portion 44, an intermediate portion 46 joined to the base portion 44 at a slightly obtuse angle, and an upper portion 48 joined to the intermediate portion 46 at an obtuse angle. The upper portion 48 is bifurcated by a slot 50. The upper edge of the upper portion 48 is provided with a pair of outwardly extending ears or pivot pins (not shown), of different diameters, that are registrable and engageable with a pair of similarly-sized apertures in the two opposed side walls of the forward portion 18 of the body, on opposite sides of the opening 31. The asymmetrical sizes of the pivot pins, and of their associated apertures, facilitate the proper orientation of the plate 42 during assembly.

With the pivot pins engaged in their associated apertures, the plate 42 is mounted for pivotal movement in a substantially vertical plane into and out of the opening 31. When the plate 42 is pivoted upwardly out of the opening 31, it is in an unlocked position, wherein the disk 35 on the free end of the actuation lever 32 is allowed to come into operable engagement with the push-button valve 13 when the trigger 36 is pressed. When the plate 42 is pivoted downwardly into the opening 31, it is in a locked position, in which the free end of the actuation lever 32 is received in the notch 50 and is thereby restrained from further movement. In this manner, the actuation lever 32 is locked in a position with its free end disengaged from the valve 13. When the plate 42 is in the locked position, its base 44 rests on a pair of parallel, longitudinal rails 56 (only one of which is shown in FIG. 1), formed on the interior surfaces of the forward portion 18 of the body 14, substantially coplanar with the shoulder 20. This support for the base 44 provides a secure locking of the actuation lever 32, and a high degree of reliability in operation.

An advantageous feature of the above described locking mechanism is that when the plate 42 is moved downwardly, it acts as a shield to block the spray from the valve 13, should the free end of the actuation lever 32 somehow fail to be received in the notch 50.

The device 10 is also provided with a pair of inwardly-extending projections or detents (not shown), formed on the interior surfaces of the opposed side walls of the forward portion 18 of the body 14, adjacent the pivot pin apertures. These detents are dimensioned so as to provide a slight frictional engagement between the detents and the sides of the plate 42. This frictional engagement requires the application of a slight pressure to urge the locking plate downward to its locked position, and upward to its unlocked position, thereby providing a detent mechanism that substantially reduces the likelihood that the locking plate will inadvertently move from its unlocked position to its locked position or from its locked position to its unlocked position.

From the foregoing description, it can be seen that the present invention offers a distinct advantage over the current state of the art, in that an easier and yet more secure attachment of the actuation and holding device to the container or can is achieved by the unique and novel structure of the rim 24, as described above. The increased ease of attachment is achieved, as discussed above, without significantly degrading the structural integrity or durability of the rim or any other part of the device. Furthermore, this improvement can be easily provided in a manner entirely consistent with conventional injection molding techniques, without additional cost or complexity.

Although a preferred embodiment has been described herein, variations and modifications of this embodiment will suggest themselves to those skilled in the pertinent arts. For example, a number of equivalents may be found to the specific configuration and placement of the rim apertures 30 to accomplish the goal of increasing flexibility without degrading structural integrity or durability. Specifically, a single aperture may be provided in each side wall 28, or one or more horizontal or vertical slots may be used. In other words, the removed side wall area can assume virtually any configuration that yields the desired combination of flexibility with structural strength. Any such variation or modification of the above-described embodiment is considered within the spirit and scope of the present invention.

What is claimed is:

1. An actuation device for holding a pressurized container and actuating a push button valve in the top of the container to dispense the pressurized contents thereof, the container having an annular channel around the valve, the device having a body including a forward portion adapted for removable attachment to the container, an actuation member in the forward portion of the body, engageable with the push button valve for actuation of the valve, trigger means, operatively connected to the actuation member, and operable to bring the actuation member into operable engagement with the valve, and attachment means, on the forward portion of the body, for removably attaching the forward portion to the container, the attachment means comprising a substantially annular rim dimensioned to be received in the channel surrounding the valve, the rim comprising front and back rim portions joined by a pair of side wall portions, each of the side wall portions having a reduced thickness area that includes integral hinge means for providing a flexing of the rim upon insertion of the front rim portion into the channel, wherein the improvement comprises:

a removed wall portion area in the reduced thickness area of each of the side wall portions that allows the side wall portions to flex resiliently in response to forces applied to the front rim portion when the rim is inserted into the channel, front rim portion first.

2. The actuation device of claim 1, further comprising interlocking means for joining the first and second rim halves at the front portion of the rim so as to limit substantial relative movement between the rim halves as the rim is inserted into the channel.

3. The actuation device of claim 1, wherein the removed wall portion area comprises an aperture in each of the side wall portions.

4. The actuation device of claim 3, wherein the removed wall portion area comprises a pair of apertures, in substantially horizontal alignment, in each of the side wall portions.

5. An actuation device for holding a pressurized container and actuating a push button valve in the top of the container to dispense the pressurized contents thereof, the container having an annular channel around the valve, the device having a body including a forward portion adapted for removable attachment to the container, an actuation member in the forward portion of the body, engageable with the push button valve for actuation of the valve, trigger means, operatively connected to the actuation member, and operable to bring the actuation member into operable engagement with the valve, and attachment means, on the forward portion of the body, for removably attaching the forward portion to the container, the attachment means comprising a substantially annular rim dimensioned to be received in the channel surrounding the valve, the rim comprising front and back rim portions joined by a pair of side wall portions, and interlocking means for joining the first and second rim halves at the front portion of the rim so as to limit substantial relative movement between the rim halves as the rim is inserted into the channel, each of the side wall portions having a reduced thickness area that includes integral hinge means for providing a flexing of the rim upon insertion of the front rim portion into the channel, wherein the improvement comprises:

a removed wall portion area in the reduced thickness area of each of the side wall portions that allows the side wall portions to flex resiliently in response to forces applied to the front rim portion when the rim is inserted into the channel, front rim portion first.

6. The actuation device of claim 5, wherein the removed wall portion area comprises an aperture in each of the side wall portions.

7. The actuation device of claim 6, wherein the removed wall portion area comprises a pair of apertures, in substantially horizontal alignment, in each of the side wall portions.

8. An actuation device for holding a pressurized container and actuating a push button valve in the top of the container to dispense the pressurized contents thereof, the container having an annular channel around the valve, the device having a body including a forward portion adapted for removable attachment to the container, an actuation member in the forward portion of the body, engageable with the push button valve for actuation of the valve, trigger means, operatively connected to the actuation member, and operable to bring the actuation member into operable engagement with the valve, and attachment means, on the forward portion of the body, for removably attaching the forward portion to the container, the attachment means comprising a substantially annular rim dimensioned to be received in the channel surrounding the valve, the rim comprising front and back rim portions joined by a pair of side wall portions, each of the side wall portions having a reduced thickness area including integral hinge means for providing a flexing of the rim upon insertion of the front rim portion into the channel, wherein the improvement comprises:

an aperture arrangement in the reduced thickness area of each of the side wall portions that allows the side wall portions to flex resiliently in response to forces applied to the front rim portion when the rim is inserted into the channel, front rim portion first.

9. The device of claim 8, wherein the aperture arrangement comprises a pair of apertures, in substantially horizontal alignment, in each of the side wall portions.

* * * * *